United States Patent [19]

Shaw

[11] Patent Number: 4,858,658

[45] Date of Patent: Aug. 22, 1989

[54] METHOD AND APPARATUS FOR REPAIRING A BROKEN WEFT THREAD IN A LOOM

[75] Inventor: Henry Shaw, Vleteren, Belgium

[73] Assignee: Picanol N.V., Belgium

[21] Appl. No.: 193,751

[22] Filed: May 13, 1988

[30] Foreign Application Priority Data

May 20, 1987 [BE] Belgium ..... 00566

[51] Int. Cl.[4] ..... D03D 47/34

[52] U.S. Cl. ..... 139/452; 139/370.2; 139/450; 242/35.6 R; 242/47.01

[58] Field of Search ..... 139/452, 1 R, 450, 116 A, 139/224 R, 256 A, 370.2, 257; 28/209, 211; 242/47.01, 35.6 R, 35.6 E

[56] References Cited

U.S. PATENT DOCUMENTS

| | | | |
|---|---|---|---|
| 4,410,018 | 10/1983 | Simson | 139/450 |
| 4,481,982 | 11/1984 | Ogasawara et al. | 139/450 X |
| 4,617,971 | 10/1986 | Hellstroem | 139/452 X |
| 4,658,866 | 4/1987 | Takegawa | 139/452 X |

FOREIGN PATENT DOCUMENTS

| | | |
|---|---|---|
| 8700223 | 3/1987 | Belgium . |
| 2700974 | 7/1978 | Fed. Rep. of Germany . |
| 2934544 | 9/1980 | Fed. Rep. of Germany . |
| 474935 | 11/1969 | Switzerland . |
| 517040 | 2/1972 | Switzerland . |

*Primary Examiner*—Andrew M. Falik
*Attorney, Agent, or Firm*—Bacon & Thomas

[57] ABSTRACT

A method for repairing a break in a weft thread which occurs before the thread accumulation space of a weft accumulator includes the steps of drawing the thread reserve present in the weft accumulator after the break back towards the end of the thread which is connected to the yarn package, and subsequently joining it thereto. A weaving machine for practicing the method includes a detection device for detecting a break in the weft thread, a threading device for drawing the thread reserve in the weft accumulator back towards the remaining weft thread, and a thread joining device.

12 Claims, 2 Drawing Sheets

Fig 5

Fig. 1
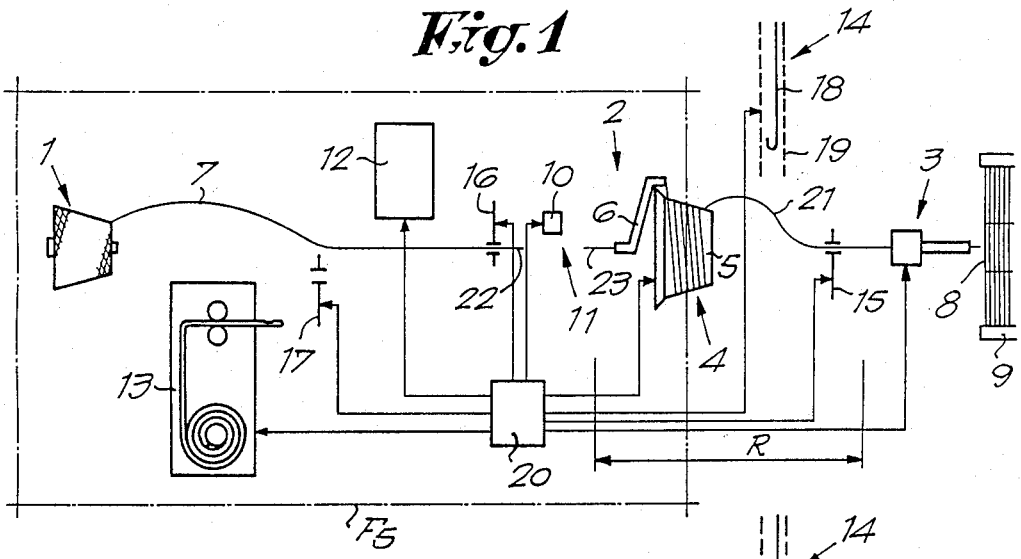
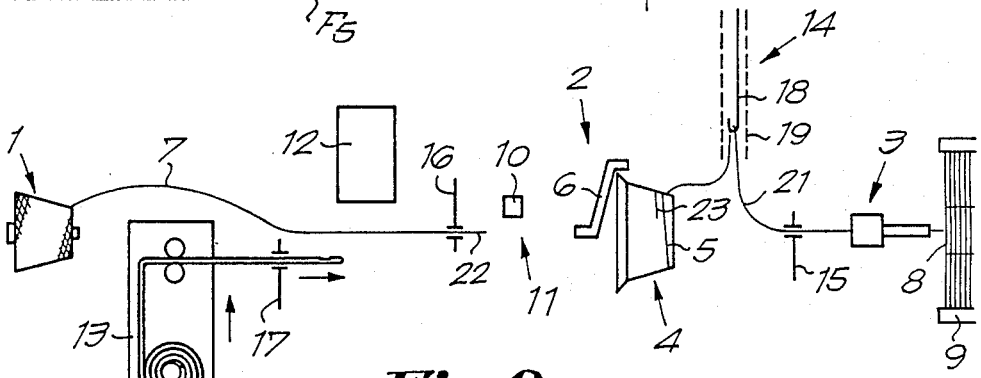
Fig. 2
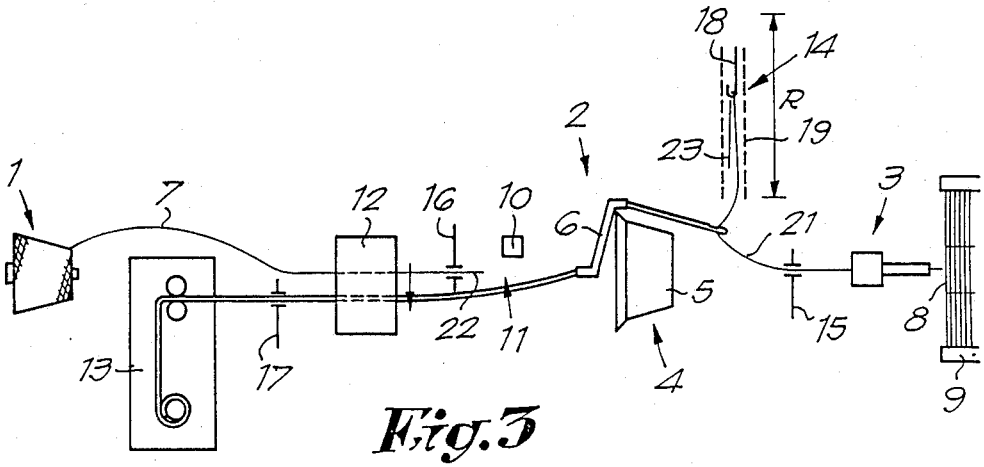
Fig. 3

METHOD AND APPARATUS FOR REPAIRING A BROKEN WEFT THREAD IN A LOOM

FIELD OF THE INVENTION

This invention concerns a method for repairing a weft thread in a weaving machine, in particular in the weft preparing device of the weaving machine, and especially on weaving machines in which the weft thread is taken from a yarn package, via a weft accumulator to a pick insertion device. More particularly, the invention provides a method for repairing breaks in the weft thread before it reaches said weft accumulator.

The method also concerns weaving machines which use said method.

SUMMARY OF THE INVENTION

The method according to the invention for carrying out a thread repair, as outlined above, in particular when a thread break occurs before the thread accumulation space of the thread accumulator, includes the steps of using the thread reserve present in the corresponding thread accumulator in order to lead the broken section of thread back over a certain distance, and then joining the broken section of thread to the end of the weft thread coming from the yarn supply. In two variants, the broken section is either joined to the weft thread from the yarn supply previously in use, or it is not so joined.

Clearly, the weaving machine according to the invention must incorporate a weft preparing device which is equipped with the necessary detection device in order to detect a thread break, as well as a thread-joining device in order to join the thread ends together, and a mechanism for leading said thread reserve back. The weft preparing device used for this purpose is described in greater detail in the following description.

In order to explain the characteristics of the invention, several variants according to the invention are described below, together with the weft preparing devices used, by way of example only and without being limitative in any way, with reference to the accompanying drawings.

BRIEF DESCRIPTION OF THE DRAWINGS

FIGS. 1 to 4 are schematic representations of the method of the invention, using a weft preparing device designed for the purpose;

DESCRIPTION OF THE PREFERRED EMBODIMENTS OF THE INVENTION

Figure 4:
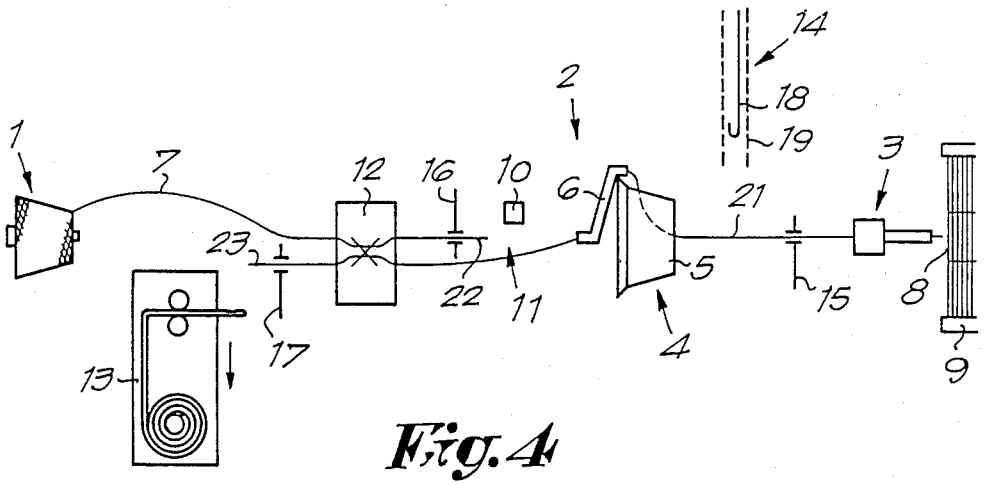

As shown in FIG. 1, the weft preparing device includes a yarn supply 1, at least one weft accumulator 2 and a pick insertion device 3. The yarn supply 1 can consist of a yarn package, as shown in the figures. The weft accumulator 2 has a thread accumulation space 4 and, in the embodiment shown, incorporates a prewinder consisting essentially of a prewinder drum 5 and a winding tube 6. By thread storage space 4 is meant the actual place in the thread accumulator 2 where the thread accumulation is formed. In the variants shown, this is the prewinder drum 5. The pick insertion device 3 here consists of a main nozzle for inserting the weft thread 7 into the shed 8, after which the weft thread can be beaten up by the reed 9. Clearly, the pick insertion device 3 can also consist of several nozzles, or a weft gripper or any other insertion device.

In the present invention, the weft preparating device in particular also incorporates: a detection device 10 in order to monitor the weft thread 7 for a possible break 11; a thread-joining device 12, a thread-backing device, here consisting of an automatic threading device 13, as known from Belgian patent application No. 8700223 made by the present applicant, a thread-freeing device 14; and a number of thread clips 15 to 17. The detection device 10 and the thread-joining device 12 can operate on the weft thread 7, in particular between the yarn supply 1 and the weft accumulator 2. Here it should be noted that the operation of the detection device 10 can be based either on detection of the presence of the thread, or on the detection of whether or not the thread is in motion. The automatic threading device 13 enables a section of thread to be drawn back through a number of the abovementioned components, in order to rethread them. This automatic rethreading device is explained in detail further on. The thread-freeing device 14 can be of any type; for example it may consist of a hooking device 18 or a tube 19 into which the thread can be drawn up pneumatically, or a combination of both. Note that the thread-freeing device 14 can operate in conjunction with weft accumulator 2.

The method in which the weft preparating device described above is used is now described with reference to FIGS. 1 to 4.

In the state shown in FIG. 1, a thread break 11 has just occurred and been detected by the detection device 10. As a consequence, e.g. by means of a control unit 20 (shown only in FIG. 1, for the sake of clarity), at least one thread reserve R consisting of a sufficient length of the broken section remains available in the weft accumulator 2.

As shown in FIG. 2, the thread-freeing device 14 is then activated, as a result of which, in this variant, the thread reserve R is completely freed, essentially by drawing it off the prewinder drum 5 by means of the hooking device 18, or by the suction of the tube 19, or by means of a blower or the like operating in conjunction with the tube 19. Meanwhile, the automatic threading device 13 is activated.

As shown in FIG. 3, the free thread reserve R thus obtained is drawn back opposite the normal direction of motion of the weft thread 7 by the threading device 13, thus, in this variant, automatically rethreading the weft accumulator 2, the thread-joining device 12 and the thread clip 17.

In this way the state shown in FIG. 4 is reached, in which the thread ends 22 and 23 formed as a result of the thread break are presented to each other and joined together by means of the thread-joining device 12. Here it should be noted that the thread-joining device 12 may consist of a tying device, a splicing device or suchlike.

Clearly, the thread clips 15 to 17 also have to be controlled accordingly, more particularly as shown in the figures. Thread clip 15 prevents the broken thread section 21 from being drawn out of the pick insertion device 3 when the thread is led back. Thread clips 16 and 17 hold the weft thread 7 and the broken section of thread 21 stretched out while their ends, 22 and 23 respectively, are being joined.

If the thread break 11 occurs before the thread clip 16, the end 22 of the weft thread 7 connected to the yarn supply 1 can be brought into thread clip 16. Sufficient devices for doing this are already known. If the thread break 11 occurs after the thread clip 16, then said end 22 can be gripped in the thread clip 16 directly.

Figure 5:
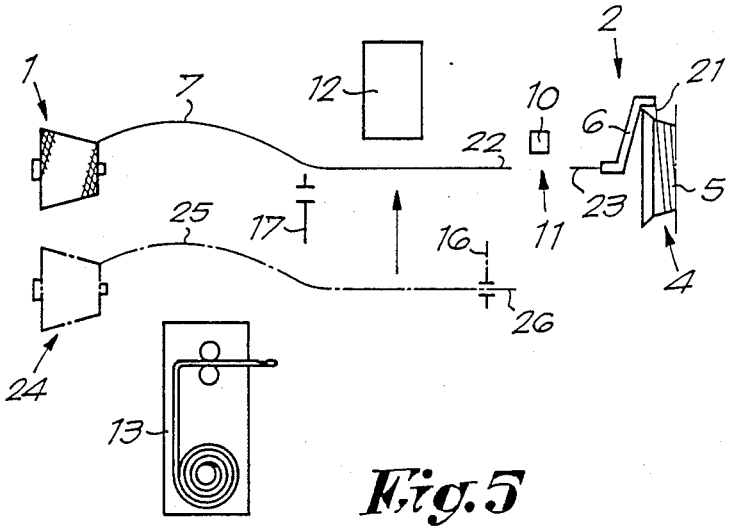
FIG. 5 shows a variant of the part indicated by F5 in FIG. 1.
Figure 6:
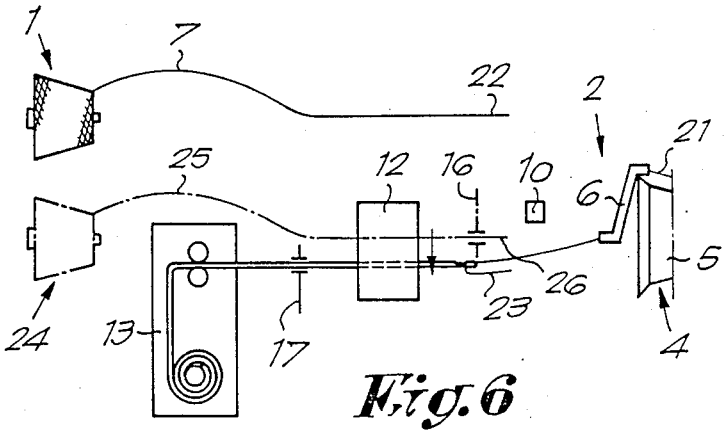
FIG. 6 shows the same part as in FIG. 5, but in a different position.

FIGS. 5 and 6 show yet another variant which makes it clear that the broken section of thread 21 does not necessarily have to be tied on to the thead end 22 from which it has broken off; instead, a suitable positioning mechanism can be used to switch over to a second yarn supply 24 whose weft thread 25 is held with its end 26 in thread clip 16, which is positioned at a different point. The switch-over can be carried out as shown in FIGS. 5 and 6. This variant is particularly advantageous whenever the end 22 of the weft thread 7 previously in use is rather difficult to find.

Naturally, more than one weft accumuator 2 can be used, so that as soon as a thread break occurs it is possible to switch over quickly to a second weft accumulator 2 which is already threaded; in this way, it is only necessary for the thread ends to be joined, while in the meantime the operation of threading the weft accumulator previously in use begins. When the next thread break occurs, the system switches over in a similar manner to the first weft accumulator 2, which in the meantime will have been rethreaded once more.

Clearly, it is also possible to use two completely independent weft preparing devices such as shown in FIG. 1, so that while a weft thread 7 is being repaired in the first one, another weft thread can be supplied to the pick insertion device 8 from the second, and vice versa.

The present invention is not limited to the examples described and the variants of the method shown in the figures, nor is it limited to the weaving machines which use the weft preparating device described above; on the contrary, the method and the weaving machines according to the invention can be realized in all sorts of variants while still remaining within the scope of the invention.

I claim:

1. A method for repairing a break in a weft thread occurring between a yarn package and a weft accumulator to form first and second broken thread sections, said weft thread being connected before the breaks to the yarn package and threaded along a first path to the accumulator for insertion into a weaving machine shed, with the first section remaining connected to the yarn package and the second section including a thread reserve portion present in the accumulator, wherein the method comprises the steps of:

a. releasing the thread reserve portion present in the accumulator and then leading the second section of thread in a direction opposite the direction of threading along a second path to a predetermined location between said yarn package and said accumulator, said second path including portions of said first path, and b. joining said first and second thread sections at said predetermined location.

2. A method as claimed in claim 1, wherein steps a and b occur in response to detection of a thread break by a thread break detection device, step a is accomplished by using a threading device to lead the second section of a thread in a direction opposite the direction of threading and thereby rethread the accumulator, and step b is accomplished by using a thread joining device.

3. A method as claimed in claim 1, wherein the weft accumulator is of the type which uses a prewinder, the prewinder including a prewinder drum and a winding tube, the thread reserve present on the accumulator being released from said prewinder drum by means of a thread-freeing device before being led through the winding tube in order to lead the second thread section in said direction opposite the direction of threading.

4. A method for repairing a break in a weft thread occurring between a yarn package and a weft accumulator to form first and second broken thread sections, said weft thread being connected before the breaks to the yarn package and threaded along a first path to the accumulator for insertion into a weaving machine shed, with the first section remaining connected to the yarn package and the second section including a thread reserve portion present in the accumulator, wherein the method comprises the steps of:

a. releasing the thread reserve portion present in the accumulator and then leading the second section of thread in a direction opposite the direction of threading along a second path to a predetermined location between said yarn package and said accumulator, said second path including portions of said first path, and b. joining said second thread section to an alternate thread which is attached to a second yarn package, said alternate thread having been previously prepared with a free end ready to be joined to said second thread section at said predetermined location.

5. A weaving machine comprising:

yarn supply means for supplying weft thread to a weaving machine;

weft accumulation means for accumulating said weft thread prior to insertion of the weft thread into a shed;

pick insertion means for inserting said weft thread into the shed, said weft thread being threaded from the yarn supply means to the pick insertion device via the accumulation means;

detection means positioned along the insertion path of the weft thread between the yarn supply means and the weft accumulation means for detecting thread breaks;

thread-joining means for joining two sections of a broken weft thread at a location between the yarn supply means and the weft accumulation means;

threading means for drawing a thread reserve in the weft accumulation means in a direction opposite the direction of weft thread threading from the yarn supply means to the pick insertion means; and control means which act on a signal from the detection means for controlling the thread-joining means and the threading means so that when a thread break is detected by the detection means, the thread reserve in the weft accumulation means is first moved in said direction opposite the direction of weft thread threading to the location where it is then joined to a section of weft connected to the yarn supply means.

6. A weaving machine as claimed in claim 5, further comprising thread-freeing means for freeing the thread reserve in the weft accumulation means prior to drawing it in said opposite direction.

7. A weaving machine as claimed in claim 6, wherein the thread-freeing means includes a hooking device.

8. A weaving machine as claimed in claim 6, wherein the thread-freeing means includes a tube into which the thread can be drawn up pneumatically.

9. A weaving machine comprising:

yarn supply means for supplying weft thread to a weaving machine;

weft accumulation means for accumulating said weft thread prior to insertion of the weft thread into a shed;

pick insertion means for inserting said weft thread into the shed, said weft thread being threaded in a first direction from the yarn supply means to the pick insertion means via the accumulation means;

a detection means positioned along the insertion path of the weft thread between the yarn supply means and the weft accumulation means for detecting thread breaks;

thread-joining means for joining two sections of a broken weft thread at a location between the yarn supply means and the weft accumulation means;

threading means for drawing a thread reserve in the weft accumulator in a direction opposite the direction of weft thread threading from the yarn supply means to the pick insertion means; and control means which act on a signal from the detection means for controlling the thread-joining means and the threading means so that when a thread break is detected by the detection means, the thread reserve in the weft accumulation means is first moved in said direction opposite the direction of weft thread threading to the location where it is then joined to an alternate weft thread connected to a second yarn supply means.

10. A weaving machine as claimed in claim 9, further comprising thread-freeing means for freeing the thread reserve in the weft accumulation means prior to drawing it in said opposite direction.

11. A weaving machine as claimed in claim 10, wherein the thread-freeing means includes a hooking device.

12. A weaving machine as claimed in claim 10, wherein the thread-freeing means includes a tube into which the thread can be drawn up pneumatically.

* * * * *